United States Patent [19]

Jurkiewitsch

[11] Patent Number: 4,798,570

[45] Date of Patent: Jan. 17, 1989

[54] PROCESS FOR PREPARING FILTER RODS

[75] Inventor: George Jurkiewitsch, Conyers, Ga.

[73] Assignee: Hercules Incorporated, Wilmington, Del.

[21] Appl. No.: 448,138

[22] Filed: Dec. 9, 1982

[51] Int. Cl.[4] ..... A24D 3/02

[52] U.S. Cl. ..... 493/44; 493/42; 493/50; 156/152; 156/510; 156/443; 156/200; 131/340; 28/255

[58] Field of Search ..... 493/42, 43, 44, 45, 493/50, 4; 28/255, 256, 282; 156/180, 199, 201, 203, 204, 152, 510, 443; 131/340, 208, 267, 269

[56] References Cited

U.S. PATENT DOCUMENTS

| | | | |
|---|---|---|---|
| 2,794,490 | 6/1957 | Crawford et al. | 156/510 |
| 2,966,157 | 12/1960 | Touey et al. | 131/208 |
| 3,016,951 | 1/1962 | Wexler | 156/200 |
| 3,050,430 | 8/1962 | Gallagher | 156/443 |
| 3,099,594 | 7/1963 | Caines et al. | 156/152 |
| 3,144,025 | 8/1964 | Erlich | 131/208 |
| 3,393,120 | 7/1968 | Touey et al. | 161/173 |
| 3,393,685 | 7/1968 | Mumpower et al. | 131/267 |
| 3,396,073 | 8/1968 | Touey et al. | 161/173 |
| 3,444,863 | 5/1969 | Soehngen et al. | 131/267 |
| 3,471,911 | 10/1969 | Nechvatal et al. | 28/72 |
| 3,832,759 | 9/1974 | Eskridge et al. | 28/255 |
| 3,880,173 | 4/1975 | Hill | 131/269 |
| 3,960,645 | 6/1976 | Brackmann et al. | 493/42 |
| 4,019,942 | 4/1977 | Kay, Jr. | 156/180 |
| 4,051,580 | 10/1977 | Curtillat | 28/255 |
| 4,221,226 | 9/1980 | Kiefer et al. | 131/267 |
| 4,411,641 | 10/1983 | Suzuki et al. | 493/50 |
| 4,435,239 | 3/1984 | Harris | 156/180 |

FOREIGN PATENT DOCUMENTS

| | | |
|---|---|---|
| 1339496 | 12/1973 | United Kingdom . |
| 1514217 | 6/1978 | United Kingdom . |

*Primary Examiner*—D. Jones

*Attorney, Agent, or Firm*—John E. Crowe

[57] ABSTRACT

An improved process for preparing fiber rods useful as cigarette filter tips comprises feeding a synthetic fiber tow through an air jet bulker directly into the garniture of a conventional cigarette filter making apparatus. The process allows production of filters with lower denier tow than has heretofore been possible while affording to the manufacturer greater versatility to change filter characteristics more readily.

4 Claims, 1 Drawing Sheet

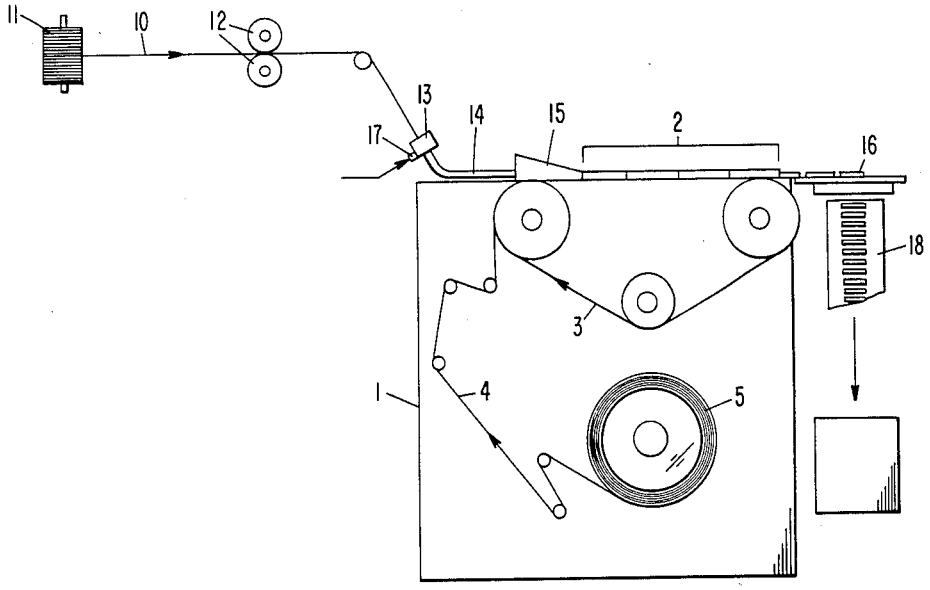
11
10
12
13
14
15
2
16
17
18
3
1
4
5

PROCESS FOR PREPARING FILTER RODS

This invention relates to an improved method of making fiber rods suitable for use as cigarette filter tips. Specifically, it relates to a method of preparing such rods making use of texturized, continuous filament synthetic polymer yarn.

Although filter tip cigarettes have been known for at least thirty-five years, the publicity given in recent years to the health hazards to which the cigarette smoker exposes himself has substantially increased their popularity. Sales of filter tip cigarettes have increased dramatically and now represent the bulk of the cigarette market. To date, the material of choice for making cigarette filters has been cotton, paper or cellulose acetate. Although a number of references have suggested the use of synthetic polymer fibers, in particular polyolefin fibers, as a replacement for cellulose acetate, it has been only recently that a serious attempt has been made to replace cellulose acetate by other synthetic polymers. As a result, polypropylene fibers have begun to capture a small portion of the market.

In preparing filter rods of synthetic fibers, the technique and equipment employed commercially to date are substantially identical to those heretofore employed in the manufacture of cellulose acetate filter rods. A good schematic description of that process can be found in U.S. Pat. No. 3,144,025. Briefly, the prior art process comprises feeding a mechanically crimped tow of the filter material, having a bulk denier of about 40,000 to 60,000, through a yarn opening mechanism where it is spread into a web, usually by means of an air blowing stream. From the opening device, it is passed through a mist of hot melt adhesive or plasticizer and then into a cylindrical shaping zone where the bundle is shaped into continuous rod form, a paper wrap is applied, and the rod is heated to activate the adhesive or plasticizer. The rod then passes to a cooling zone wherein the adhesive or plasticizer hardens to fix and maintain the shape, following which the rod is cut to the desired length.

The use of mechanically crimped tow imposes limitations on the process just described. The texture of the yarn employed in filter rod manufacture greatly affects the characteristics of the resultant filter such as its air permeability resistance as measure by its pressure drop, its firmness, and its weight. The requisite variations in texture, to produce filters to different specifications, are different to achieve controllably with mechanical crimping apparatus. Moreover, the apparatus employed in mechanical crimping of a tow is massive and complicated and not suited to use by the rod manufacturer. Thus, he is forced to purchase crimped tow, which is only sold in relatively large quantities of fixed, unchangeable characteristics. As a result, the versability of his rod making equipment is not as great as might be desired.

It is the object of this invention to provide a new, improved, highly versatile method of preparing filter rods. A further object is to provide an improved filter rod based on a bulked or texturized continuous filament rather than a mechanically crimped tow. Yet another object is to provide a method of preparing filter rods from an uncrimped tow of substantially lower bulk denier than has heretofore been employed.

Briefly stated, the improved filter rod manufacturing technique of this invention comprises passing a continuous filament synthetic yarn tow of about 6,000 to 10,000 bulk denier through a fluid texturizing jet under temperature and pressure conditions such that the bulk index of the said yarn is increased by about 25 to 75%, and passing the resultant texturized yarn directly and continuously from the egress of said texturizing jet into the garniture of a filter rod making apparatus, and forming it into a filter rod while maintaining a relative speed ratio of about 15:1 to 25:1 between the egress from the jet and the filter rod take-off, whereby the yarn is compacted within the garniture to a predetermined degree, and wrapping the said filter rod to maintain the shape and compaction upon take-off from the apparatus.

The improved method of the invention can be readily carried out using a conventional cigarette filter apparatus modified only as to the method of feeding the two and the tow being fed thereto. The apparatus, method and product of the invention are depicted in the attached drawing, which is a schematic drawing of conventional cigarette filter making apparatus adapted to the instant invention.

Referring now to the drawing, there is shown generally a conventional cigarette filter manufacturing apparatus 1, including a garniture section 2, a garniture belt 3, for delivering a constant supply of cigarette wrapping paper 4 to the garniture section 2 from supply roll 5. The garniture section 2 includes means for shaping and retaining the filter tow in a cylindrical shape, means for wrapping it with the cigarette wrapping paper, means for heat sealing the paper after wrapping, and means for cutting the resultant continuous shaped and wrapped tow into filter rods 16 of a predetermined length. The cut filter rods are removed by a conveyor or other means 18 to storage and pack out. All of the apparatus and the operations described to this point are conventional, per se, forming no part of the novelty of the invention and are thus not shown in any detail.

In carrying out the method of the invention, a continuous tow 10 of synthetic filaments is drawn from a creel 11 (or from several creels) by feed rolls 12 and fed into a fluid bulking or texturizing jet 13. The two is contacted in the jet by a hot fluid, such as, e.g., steam or hot air, supplied as indicated by the arrow, through nozzle 17, from a source not shown, in such a manner that the heat and turbulence created within the jet causes a random deformation of filaments with a resultant manyfold increase in the bulk of the tow. The specific amount of bulk imparted can be varied widely by varying the fluid flow, fluid temperature, and feed rate through the jet. From the jet, the tow is forwarded through guide tube 14 into trumpet 15 and thence into the garniture where it is formed into filter rods as described hereinabove.

The tow which is employed in this invention can be any synthetic filament tow which is amenable to texturizing with the fluid jet apparatus. Thus, it can be a polyester, polyamide, arylic, polypropylene, or acetate tow. Due to its relatively low density, compared to other synthetic fiber-forming materials, polypropylene (including filament-forming copolymers of propylene with ethylene or other lower olefins) is a preferred tow material.

The bulk denier of the tow employed in carrying out the method of the invention can be between about 6,000 and 10,000. This total denier can be supplied from a single creel or it can be a composite of several creels combined and passed through the fluid jet simultaneously. For best performance in cigarette filters, it is preferred that the tow be substantially untwisted and untexturized prior to entering the fluid jet.

The fluid jet 13 employed to effect texturization of the tow is of conventional design similar to that described in, e.g., U.S. Pat. No. 3,471,911 to Nechvatal & Parks. The jet is adapted to use in the inventive process by the addition thereto of guide tube 14.

Guide tube 14 is employed principally for the purpose of confining the highly texturized yarn as it traverses the gap between texturizing jet 13 and garniture trumpet 15. The high degree of texturization imparted to the yarn and the turbulence around the exit of the jet can cause the yarn to lose its structural integrity and become undesirably entangled if the yarn is not confined in this area. Moreover, as will be discussed hereinafter, the yarn is subjected to a relatively high degree of overfeed between the jet and the garniture section. If unconfined, it could get completely out of control at this point. A peripheral, unexpected benefit realized from running the yarn through guide tube 14 is that the confinement and packing upon itself, which the yarn experiences in the tube, adds an additional increment of texturization to the yarn.

Between the egress from the fluid jet and the garniture belt 3, which provides the motive force for moving the tow through the garniture, there exists a significant yarn speed differential or overfeed. This overfeed is between about 15 to 1 and 25 to 1. As a result, the yarn in the delivery tube 14 and trumpet 15 is packed into the garniture in a random zig-zag fashion and remains so packed as it is wrapped, sealed and cut to size.

By virtue of the overfeed and packing of the yarn, filters prepared by the method of the invention can have substantially the same amount of fiber as is present in filters made by use of conventional technology, even though the bulk denier of the tow fed to the process is only a fraction of that of the tow employed in the conventional commercial process. Thus, those characteristics of the filter, such as the air permeability (pressure drop), filter weight (allowing, of course, for differences in specific gravity of the polymer), and firmness, which reflect the amount of fiber therein, are maintained. The specific amount of yarn in a filter can, of course, be varied by varying the overfeed rate.

It has also been observed that in many cases the method of the invention permits the manufacture of filters without the use of an adhesive to retain a regular cylindrical configuration. The compaction of the texturized yarn into the rod imparts a high degree of potential energy to the yarn in the direction perpendicular to the long axis of the rod. Containment of this energy by the wrapper maintains the filter rod in the required uniform cylindrical shape. If the specifications for the particular filter being manufactured so require, e.g., in a case where the filter would not be firm enough without a hardener, an adhesive hardener can be employed.

The greatest advantage of the method of the invention, however, is the versatility which it gives to the filter manufacturer to adjust the yarn characteristics during the operation of the process. The bulk or texturization level of the yarn can be readily adjusted by varying the operation of the jet. Yarn throughput rate, fluid pressure, fluid temperature and degree of overfeed can all be varied within relatively wide limits to yield the specific yarn characteristics needed to produce desired filter characteristics. It is not necessary to change feed yarn to effect changes in filter characteristics. From the preceding, it will be apparent that changeover between filters meeting different specifications is greatly facilitated. Moreover, these advantages are achieved with a relatively small capital investment on the part of the filter manufacturer.

While the invention is described herein in terms of its value for manufacturing cigarette filters, it will be apparent that it can be employed in other applications where an elongated, fiber packed filter rod is required.

EXAMPLE 1

Heat stabilized polypropylene of melt flow rate 18–20 and containing $TiO_2$ as delusterant was converted into 2.5 denier per filament (dpf) spun yarn using a 210 hole spinnerette with "Y" cross section capillaries and drawn 2.5X. Spinning and drawing were carried out at conventional commercial conditions. Four ends of the 2.5 dpf yarn were unwound parallel from a "roll-off" creel at a tension of about 0.01 gram/denier and combined to form a tow containing 840 filaments and having a total denier of 2,100.

The 2,100 denier tow was fed through a bulking jet into the garniture of a 20 denier filter rod making machine. Superheated steam at 70±2 psi was fed to the jet, maintaining a temperature of about 107°–110° C. in the capillary of the jet. A speed differential of about 10/1 was maintained between the rod maker belt and the tow feed rolls. The combined bulking effected in the jet, in the guide tube, and in the garniture resulted in a density change of about 21.9 to 1 between the filter rod and the tow.

The resulting filter rods exhibited acceptable pressure drop on smoking machines and acceptable rod weight. Rod hardness was acceptable for most applications. Physical properties are recorded in Table 1 below.

EXAMPLE 2

A 1:1 blend of 2.5 dpf and 3.5 dpf "Y" cross section polypropylene yarns, prepared substantially as described in Example 1 was combined into a 2,500 denier tow. This was fed through the texturizing jet and formed into filter rods using hot air at 140±5° C. as fluid medium at a speed ratio of about 12 to 1 between feed rolls and rod maker belt.

The overall increase in bulk density was about 23 to 1. Filter rod properties, recorded in Table 1, were good. In particular, the hardness was acceptable for virtually all applications.

EXAMPLE 3

Using the yarns of Example 2 in a 1:3 ratio, a 2,730 denier tow was prepared and formed into filter rods using superheated steam as the fluid texturizing medium. Ratio of feed roll speed to belt speed was about 10:1.

The increase in bulk density was about 22 to 1. Rod properties were very good. See Table 1.

EXAMPLE 4

The polymer employed in previous examples was spun and drawn in the manner described into a 4 dpf yarn. Three ends of this yarn were combined into a 2,500 denier tow and fed through the texturizing jet into the rod making machine. Superheated steam was employed as the fluid medium. Rod properties were good. See table 1.

TABLE 1

| Example No. | Rod Weight (g./1000) | Pressure* Drop (mm H2O) | Hardness** % F | Yield ΔP/RW |
|---|---|---|---|---|
| 1 | 429 | 506 | 85.2 | 118 |
| 2 | 538 | 565 | 90.8 | 105 |
| 3 | 544 | 617 | 89.4 | 113 |
| 4 | 477 | 536 | 92.3 | 112 |

*Determined with Filtrona LP 1100 Pressure Drop Tester.
**Determined with Filtrona Hardness and Resilience Tester.

What I claim and desire to protect by Letters Patent is:

1. A method for preparing a synthetic polymer fiber filter rod from uncrimped tow of low bulk denier which comprises passing bulked or texturized yarn tow of continuous synthetic filaments having a bulk denier of about 6,000–10,000 through a fluid bulking or texturizing jet under temperature and pressure conditions sufficient to obtain bulked yarn having a bulk index increase of about 25–75%; and guiding and feeding the resulting bulked yarn directly from the egress of the said fluid bulking or texturizing jet into the garniture of a downstream-positioned filter rod-making apparatus, the velocity ratio of said bulked yarn at the egress of said fluid texturizing jet-to-velocity at filter rod take-off of the filter rod-making apparatus being about 15:1 to 25:1, whereby overfed bulked yarn is continuously randomly compacted within the garniture of said filter rod-making apparatus prior to wrapping and cutting.

2. The method of claim 1 wherein the yarn tow comprises at least one of a polyester, polyamide, acrylic, polypropylene, acetate or filament-forming copolymers thereof.

3. The method of claim 1 wherein the yarn two comprises polypropylene or a copolymer thereof with a lower olefin.

4. The method of claim 1 wherein the tow is substantially untwisted and untextured prior to entering the fluid texturizing jet.

* * * * *

UNITED STATES PATENT AND TRADEMARK OFFICE

CERTIFICATE OF CORRECTION

PATENT NO. : 4,798,570

DATED : JANUARY 17, 1989

INVENTOR(S) : George Jurkiewitsch

It is certified that error appears in the above-identified patent and that said Letters Patent is hereby corrected as shown below:

Column 2, line 14;

Column 2, line 40;

and

Column 6, line 16 of Claim 4;

" two " should read -- tow -- .

Signed and Sealed this

Thirteenth Day of June, 1989

*Attest:*

DONALD J. QUIGG

*Attesting Officer*

*Commissioner of Patents and Trademarks*